US009412253B2

(12) United States Patent
Maxik et al.

(10) Patent No.: US 9,412,253 B2
(45) Date of Patent: Aug. 9, 2016

(54) SYSTEM FOR DETECTING AND ANALYZING MOTION FOR PATTERN PREDICTION AND ASSOCIATED METHODS

(71) Applicant: Biological Illumination, LLC, Melbourne, FL (US)

(72) Inventors: Fredric S. Maxik, Cocoa Beach, FL (US); David E. Bartine, Cocoa, FL (US); Robert R. Soler, Cocoa Beach, FL (US)

(73) Assignee: Biological Illumination, LLC, Melbourne, FL (US)

( * ) Notice: Subject to any disclaimer, the term of this patent is extended or adjusted under 35 U.S.C. 154(b) by 0 days.

(21) Appl. No.: 14/615,082

(22) Filed: Feb. 5, 2015

(65) Prior Publication Data

US 2015/0221197 A1 Aug. 6, 2015

Related U.S. Application Data

(60) Provisional application No. 61/936,654, filed on Feb. 6, 2014.

(51) Int. Cl.
*G08B 21/02* (2006.01)
*G08B 21/04* (2006.01)

(52) U.S. Cl.
CPC ..... *G08B 21/0469* (2013.01); *G08B 21/0423* (2013.01)

(58) Field of Classification Search
CPC ..... G08B 21/0202; G08B 21/0205; G08B 21/18; G08B 21/182; G08B 21/22; G08B 21/0423; G08B 21/0415; G08B 13/19613; H04H 60/33; H04H 60/45; H04H 60/46; G05B 13/042; G05B 13/04; G06N 99/005
See application file for complete search history.

(56) References Cited

U.S. PATENT DOCUMENTS 6,825,761 B2 * 11/2004 Christ ..... G08B 13/189 340/506
8,674,608 B2 3/2014 Holland et al.
8,680,457 B2 3/2014 Maxik et al.
8,686,641 B2 4/2014 Maxik et al.
8,761,447 B2 6/2014 Maxik et al.
8,818,202 B2 8/2014 Maxik et al.

(Continued)

OTHER PUBLICATIONS

Holland et al., U.S. Appl. No. 61/486,314, filed May 15, 2011, (39 pages).

(Continued)

*Primary Examiner* — An T Nguyen
(74) *Attorney, Agent, or Firm* — Mark Malek; Daniel Pierron; Widerman Malek, PL

(57) ABSTRACT

A method of monitoring movement and predicting a pattern of an individual by a monitoring system comprising a server and a plurality of occupancy-detecting luminaires in communication with the server comprising the steps of receiving an indication of a detected occupancy of an individual from a luminaire of the plurality of luminaires and determining if the system is presently in a pattern for the individual associated with the indication of detected occupancy. Upon a determination that the system is not presently in a pattern, the indication of detected occupancy is written to a record, the record is compared to a database of patterns, and it is determined if a pattern is identifiable from the record. Upon a determination that the system is presently in a pattern, it is determined whether the indication of detected occupancy complies with the pattern.

20 Claims, 3 Drawing Sheets

(56) References Cited

U.S. PATENT DOCUMENTS

| | | | | |
|---|---|---|---|---|
| 9,024,536 | B2 | 5/2015 | Maxik et al. | |
| 2002/0148944 | A1* | 10/2002 | Tatum | G01S 7/412 250/203.1 |
| 2006/0261962 | A1* | 11/2006 | Berenguer | G08B 21/0492 340/573.1 |
| 2006/0267780 | A1* | 11/2006 | Adams | A61B 5/1113 340/573.1 |
| 2011/0090085 | A1* | 4/2011 | Belz | G08B 21/0423 340/573.1 |
| 2011/0191158 | A1 | 8/2011 | Kateraas et al. | |
| 2012/0086568 | A1* | 4/2012 | Scott | G05B 15/02 340/501 |
| 2012/0287242 | A1 | 11/2012 | Gilboa et al. | |
| 2012/0287271 | A1 | 11/2012 | Holland et al. | |
| 2014/0015438 | A1 | 1/2014 | Maxik et al. | |
| 2014/0296943 | A1 | 10/2014 | Maxik et al. | |

OTHER PUBLICATIONS

Soler et al., U.S. Appl. No. 61/923,924, filed Jan. 6, 2014, (35 pages).

Maxik et al., U.S. Appl. No. 61/924,435, filed Jan. 7, 2014, (12 pages).

Maxik et al., U.S. Appl. No. 61/948,185, filed Mar. 5, 2014, (30 pages).

* cited by examiner

SYSTEM FOR DETECTING AND ANALYZING MOTION FOR PATTERN PREDICTION AND ASSOCIATED METHODS

RELATED APPLICATIONS

This application claims the benefit under 35 U.S.C. §119 (e) of U.S. Provisional Patent Application Ser. No. 61/936,654titled System for Detecting and Analyzing Motion for a Pattern Prediction and Associated Methods filed Feb. 6, 2014, the content of which is incorporated by in its entirety herein by reference, except to the extent disclosure therein is inconsistent with disclosure herein. This application is also related to U.S. Patent Application Ser. No. 61/924,435 titled Luminaire for Performing Distributed Computing and Associated Methods filed Jan. 7, 2014, U.S. patent application Ser. No. 13/464,345 titled Occupancy Sensor and Associated Methods filed May 4, 2012, U.S. Pat. No. 8,818,202 titled Wavelength Sensing Lighting System and Associated Methods for National Security Application filed May 23, 2013, U.S. Pat. No. 8,674,608 titled Configurable Environmental Condition Sensing Luminaire, System and Associated Methods filed Feb. 23, 2013, U.S. Pat. No. 5,680,457 titled Motion Detection System and Associated Methods Having At Least One LED of a Second Set of LEDS to Vary its Voltage filed Jan. 11, 2013, U.S. patent application Ser. No. 13/464,292 titled Intelligent Security Light and Associated Methods filed May 4, 2013, U.S. patent application Ser. No. 14/208,370 titled Method for Controlling Blood Glucose Levels and Digestion Cycles filed Mar. 13, 2014, U.S. Provisional Patent Application Ser. No. 61/923,924 titled Luminaire for Varying Biologically-Adjusted Illumination According to a User-Controllable Circadian Pattern and Associated Systems and Methods filed Jan. 6, 2014, U.S. Provisional Patent Application Ser. No. 61/948,185 titled System for Dynamically Adjusting Circadian Rhythm Responsive to Scheduled Events and Associated Methods filed Mar. 5, 2014, U.S. patent application Ser. No. 14/315,660 titled Tunable LED Lamp for Producing Biologically-Adjusted Light and Associated Methods filed Jun. 26, 2014, and U.S. patent application Ser. No. 13/055,591 titled Physical Activity Tracking and Rewards Allocation System filed Mar. 31, 2011, the contents of each of which are incorporated herein by reference in their entirety except to the extent disclosures therein are inconsistent with disclosures herein.

FIELD OF THE INVENTION

The present invention relates to systems and methods for monitoring the movement patterns of an individual and identifying deviations therefrom.

BACKGROUND

Current methods of monitoring an individual within a monitored environment are heavily dependent upon, first, electronic devices including expensive imaging devices with sufficient resolution to distinguish motion by the monitored individual, and, second, usually require significant human interaction in the monitoring of the individual. Moreover, these systems often require separate installation from other electrical systems of the facility in which they are being installed. Moreover, where the facility is being retrofitted, such an installation can be costly. It is advantageous for a monitoring system to integrate with existing infrastructure of the facility, such as, for example, the lighting system. Accordingly, there is a need in the art for a monitoring system that does not rely on imaging technology, reduces human interaction in monitoring, and reduces the extent to which retrofitting is needed.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a method for monitoring patterns of movement using a lighting system comprising a plurality of luminaires in communication with a server. The method may comprise the steps of detecting occupancy within a vicinity of at least one of the luminaires of the plurality of luminaires, defined as a detected occupancy, receiving the detected occupancy from the at least one luminaire at the server, and determining if the lighting system is presently operating in a pattern. Upon a determination that the lighting system is presently operating in a pattern, the method may comprise performing the steps of determining if the detected occupancy complies with the pattern defining a pattern compliance and updating a pattern status responsive to the pattern compliance. Additionally, upon a determination that the lighting system is not presently operating in a pattern, the method may comprise performing the steps of recording the detected occupancy to a record, determining if a pattern is identifiable responsive to the detected occupancy defining a pattern identification, and at least one of setting a system pattern and performing an action responsive to the pattern identification.

In some embodiments, upon a determination that the pattern status is not in compliance with the pattern compliance, the method may comprise performing the step of updating the pattern status to reflect noncompliance with the pattern.

In some embodiments, upon a determination that the pattern status is in compliance with the pattern compliance, the method may comprise performing the steps of updating the pattern status to reflect compliance with the pattern, detecting occupancy within the vicinity of the at least one luminaire, defined as a subsequent detected occupancy, receiving the subsequent detected occupancy from the at least one luminaire at the server, determining if the subsequent detected occupancy complies with the pattern defining a subsequent pattern compliance, and at least one of updating the pattern status and performing an action responsive to the subsequent pattern compliance. Furthermore, responsive to the subsequent pattern compliance indicating compliance with the pattern, the method may comprise the step of updating the pattern status to reflect compliance with the pattern of the subsequent pattern compliance.

Additionally, responsive to the subsequent pattern compliance indicating noncompliance with the pattern, the method may comprise performing the steps of determining if a threshold number of noncompliant subsequent pattern compliances has been reached defining a compliance threshold indication, updating the pattern status to reflect noncompliance with the pattern of the subsequent pattern compliance responsive to the compliance threshold indication indicating the threshold number of noncompliant subsequent pattern compliances has not been reached, and performing an action responsive to the compliance threshold indication indicating the threshold number of noncompliant subsequent pattern compliances has been reached. Furthermore, performing the action may comprise at least one of providing an alert, sending a message, placing a telephone call, sending a message to a monitoring service, providing a visual or auditory signal at either of the space associated with the lighting system and a location remote thereto.

In some embodiments, the method may further comprise the steps of, responsive to the subsequent pattern compliance indicating compliance with the pattern, updating the pattern status to reflect compliance with the pattern of the subsequent pattern compliance, and responsive to the subsequent pattern compliance indicating noncompliance with the pattern, performing the steps of determining if a threshold number of noncompliant subsequent pattern compliances has been reached defining a compliance threshold indication, updating the pattern status to reflect noncompliance with the pattern of the subsequent pattern compliance responsive to the compliance threshold indication indicating the threshold number of noncompliant subsequent pattern compliances has not been reached, and performing an action responsive to the compliance threshold indication indicating the threshold number of noncompliant subsequent pattern compliances has not been reached. Additionally, the method may further comprise iteratively performing precedent steps until at least one of the subsequent pattern compliance indicates compliance with the pattern and the compliance threshold indication indicates the threshold number of noncompliant subsequent pattern compliances has been reached.

In some embodiments, responsive to the pattern identification indicating a pattern is identifiable, the method may comprise performing the step of setting a system pattern such that the lighting system can be determined to be in a pattern. Additionally, responsive to the pattern identification indicating a pattern is non-identifiable, the method may comprise performing the steps of detecting occupancy at a luminaire, defined as a subsequent detected occupancy, receiving the subsequent detected occupancy from the luminaire at the server, recording the subsequent detected occupancy to the record, determining if a pattern is identifiable responsive to the subsequent detected occupancy defining a subsequent pattern identification, and at least one of setting the system pattern and performing an action responsive to the subsequent pattern identification.

In some embodiments, the method may further comprise the steps of, responsive to the subsequent pattern identification indicating a pattern is identifiable, performing the step of setting a system pattern such that the lighting system can be determined to be in a pattern, and responsive to the subsequent pattern identification indicating a pattern is non-identifiable, performing the steps of determining if a threshold number of non-identifiable subsequent pattern identifications has been reached, defining an identification threshold indication, responsive to the identification threshold indication indicating the threshold number of non-identifiable subsequent pattern identifications has been reached, performing an action, and responsive to the identification threshold indication indicating the threshold number of non-identifiable subsequent pattern identifications has not been reached, iteratively receiving subsequent occupancy detections, recording subsequent occupancy detections, and determining subsequent pattern identifications until at least one of a subsequent pattern identification indicates a pattern is identifiable and the identification threshold indication indicates the threshold number of non-identifiable subsequent pattern identifications has been reached.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
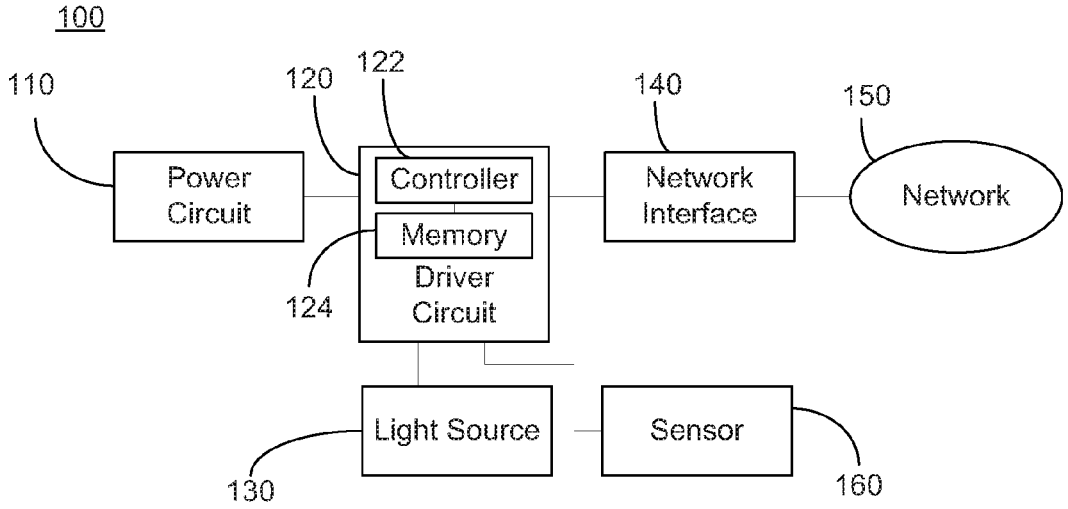
FIG. 1 is a schematic view of a lighting device according to an embodiment of the invention.

An embodiment of the invention text, as shown and described by the various figures and accompanying text, provides a system for detecting and analyzing patterns of motion using lighting devices. Referring now to FIG. 1, a schematic representation of a lighting device 100 of an embodiment of the present invention is depicted. The lighting device 100 may include a power circuit 110, a driver circuit 120 and a light source 130. The power circuit 110 may be configured to be positioned in electrical communication with an external power source. For example, the power circuit 110 may be configured to be positioned in electrical communication with an external power supply. Moreover, the power circuit 110 may be positioned in electrical communication with at least one of the driver circuit 120 and the light source 130. Additionally, the power circuit 110 may be configured to receive electrical power having characteristics, such as voltage levels and current type, of a first type and conditioning the electrical power to the suitable for use by the various elements of the lighting device 100. For example, the power circuit 110 may be configured to receive AC electrical power of any standard AC power transmission voltage range and configured to deliver DC electrical power within the range from 1 V to 20 V to the various electrical elements of the lighting device 100.

The driver circuit 120 may be positioned in electrical communication with the light source 130. Additionally, the driver circuit 120 may be configured to control the operation of the light source 130. In some embodiments, the driver circuit 120 may include a controller 122 and a memory 124 positioned in electrical communication with the controller 122. The controller 122 may be any device capable of performing data processing functions, including, but not limited to, a central processor (CPU), microcontroller, a gate array, a system-on-a-chip, a general purpose processing element, or a collection of electronic component capable of processing data.

The memory 124 may include volatile and/or non-volatile memory modules. Volatile memory modules may include random access memory, which may temporarily store data and code being accessed by the controller 122. The non-volatile memory may include flash based memory, which may store a computerized program to be executed by the controller 122. Furthermore, the memory 124 may include transitory and/or non-transitory memory modules. The memory 124 may also be configured to store data collected by the lighting device 100, additional details about which are provided hereinbelow.

The light source 130 may be any device that is operable to emit light. In some embodiments, the light source 130 may comprise a plurality of LEDs. The plurality of LEDs may be operable to emit light having varying characteristics, including, but not limited to, brightness, chromaticity, color rendering index, and the like. More specifically, the light source 130 may be operable by the driver circuit 120 so as to emit light having any of the aforementioned varying characteristics. More information regarding the operation of the light source 130 may be found in U.S. patent application Ser. No. 13/737,606 titled Tunable Light System and Associated Methods filed Jan. 9, 2013, and U.S. patent application Ser. No. 13/311,300 titled and Tunable LED Lamp for Producing Biologically-Adjusted Light filed Dec. 5, 2011, the contents of which are incorporated herein in their entirety by reference.

In some embodiments, the lighting device 100 may further comprise a network interface device 140. The network interface device 140 may be positioned in electrical communication with the driver circuit 120. The network interface device 140 may be configured to communicate across a network 150 so as to transmit and/or receive instructions and/or data related to the lighting device 100 across the network 150. The network interface device 140 may be configured to connect to the network 150 using any proprietary or standard connection protocol examples of protocols include, but are not limited to, 802.3 Ethernet, 802.11 Wi-Fi, 802.15.1 Bluetooth, 802.15.4 low rate personal area network (PAN) environments, packet switching wide area networks (WAN), cellular networks, and the like. Moreover, the network interface device 140 may be configured to communicate across a mesh network, where the mesh network comprises two or more lighting devices 100 positioned in communication with each other across the network 150. More information regarding the network 150 will be discussed in greater detail hereinbelow.

In some embodiments, the lighting device 100 may further comprise a sensor 160. The sensor 160 may be configured to detect the presence or absence of a target within its field of view. A "target" may be understood to mean an object for which the lighting device 100 is configured to detect the movement/occupancy thereof. The target may be any object, including, but not limited to, persons, animals, or mechanical devices. Moreover, in some embodiments, the sensor 160 may be configured to determine whether a target is moving or is stationary. The sensor 160 may be any electrical device capable of achieving such function, including, but not limited to, motion detectors, cameras, acoustic detectors, and the like.

In some embodiments, where the light source 130 comprises a plurality of LEDs, the sensor 160 may be embodied by the light source 130 whereby the light source 130 is configured to operate so as to achieve the target detection described hereinabove. More details regarding the operation of the light source 130 and its capacity may be found in U.S. patent application Ser. No. 13/901,169 titled Wavelength Sensing Lighting System and Associated Methods for National Security Application filed May 23, 2013 and U.S. patent application Ser. No. 13/739,665 titled Motion Detection System and Associated Methods filed Jan. 11, 2013, the contents of which are incorporated by reference hereinabove.

Those skilled in the art will also appreciate that the driver circuit 130 may be carried by a radio logic board, and that the lighting device 100 may include an antenna coupled to the radio logic board. The antennal may, for example, be used to transmit a signal that caries data. The radio logic board may be separated from heat producing elements of the luminaire by a buffer distance. The buffer distance is a distance suitable to facilitation reduction of attenuation of the signal. Additional details and illustrations of the radio logic board, as well as the buffer distance where the radio logic board is positioned, are set forth in U.S. Provisional Patent Application No. 61/486,314 titled WIRELESS LIGHTING DEVICE AND ASSOCIATED METHODS filed on May 15, 2011, the entire contents of which are incorporated herein by reference.

Figure 2:
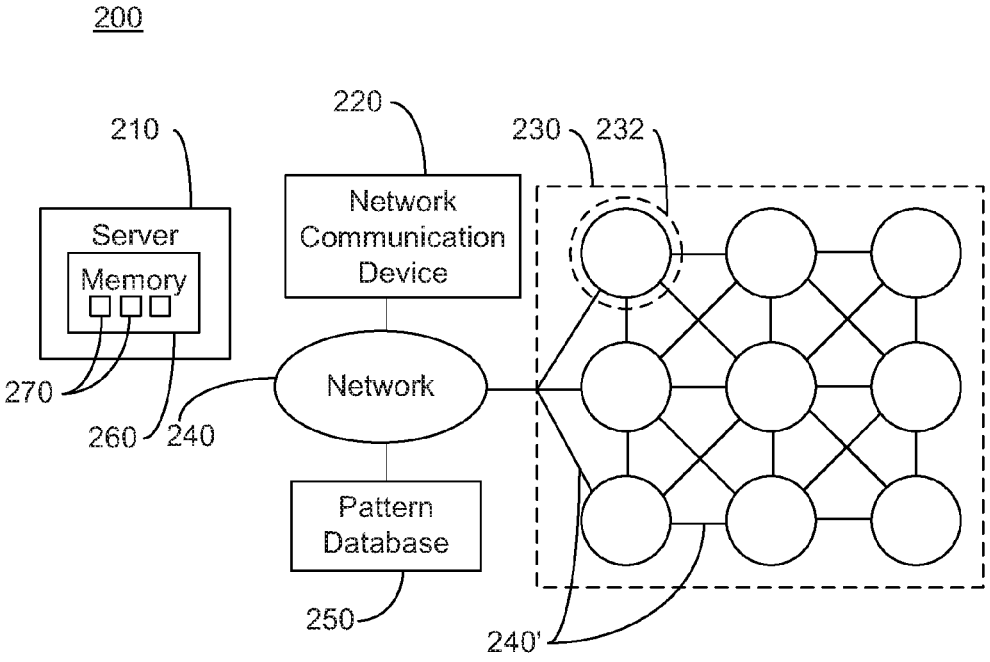
FIG. 2 is a schematic view of a lighting system according to an embodiment of the invention.

Referring now to FIG. 2, a lighting system 200 according to an embodiment of the invention will now be discussed. The lighting system 200 may comprise a server 210, a network communication device 220, and a network of lighting devices 230. The server 210 may be positioned in electrical communication with the network communication device 220. Additionally, the plurality of lighting devices 230 may be positioned in electrical communication with the network medication device 220. The plurality of lighting devices 230 may each be provided by a lighting device as described hereinabove.

Additionally, in some embodiments, the server 210 may be positioned in communication with a network 240 via the network communication device 220. The network 240 may be a wide area network (WAN) or the Internet. Additionally, in some embodiments, the network communication device 220 may be configured to communicate with each lighting device 230 of the plurality of lighting devices 230 across the network 240. Furthermore, the server 210 may be positioned in communication with a pattern database 250. Additional details regarding the pattern database 250 will be discussed hereinbelow in greater detail. Additionally, in some embodiments, the server may be positioned in communication with additional types of networks, including, but not limited to, telecommunication networks, telephone networks, cellular communication networks, local area networks (LAN), and the like.

The network of lighting devices 230 may comprise a plurality of luminaires configured to detect motion and/or occupancy within a field of view 232 of the luminaires. More specifically, each lighting device of the network of lighting devices 230 may be configured to detect motion and/or occupancy within the field of view 232 associated with a lighting device of the network of lighting devices 230, and may additionally be configured to communicate such detection. The detection may be communicated across the network 240. In some embodiments, the detection may be communicated across a mesh network 240', whereby each lighting device of the network of lighting devices 230 functions as a node in the mesh network 240'. In some embodiments, the detection may be communicated across the network 240 and be received by a server 210. While a mesh network 240' is discussed and shown in FIG. 2, it is contemplated and included within the scope of the invention that a hub-and-spoke network, whereby each lighting device of the network of lighting devices 230 is in communication with at least one of the server 210 and the network communication device 220 and not in communication with another lighting device of the network of lighting devices 230. Additionally, hybrid networks of mesh and hub-and-spoke configurations are contemplated and included within the scope of the invention, including the ability to transition between the two.

The location of each lighting device 230 of the network of lighting devices 230 may be selected so as to advantageously include within the field of view 232 of the luminaire 232 a desired monitored space. The desired monitored space may depend upon the nature of the monitoring to be performed. In some embodiments, a residential monitoring may be desired, whereby the movement patterns of a person or persons within a residence any monitored. Accordingly, the network of lighting devices 230 may be positioned so as to include within their respective fields of view 232 a substantial portion of the interior space of the residents that is occupied by the person or persons. A residential embodiment is exemplary only, and it is contemplated and included within the scope of the invention that the network of lighting devices 230 described herein may be deployed in any area, including, but not limited to, commercial spaces, retail spaces, outdoor spaces, or any other space where patterned motion and/or occupancy may occur and may be desired to be monitored. Accordingly, the system 200 may be deployed in a space where motion and/or occupancy have a degree of predictability.

For example, and with reference to retail spaces, it may be desirous for motion of consumers to be detected and monitored. More particularly, it may be desirous to determine where consumer traffic patterns are located within a retail space to be in position on various items within the retail space. The present invention advantageously allows for monitoring of such consumer traffic patterns.

When a lighting device 230 transmits an indication of detection of motion and/or occupancy, such a transmission may include an indication of the location of the lighting device 230. This may be accomplished by including an identifier the transmission that may indicate from which luminaire the communication is transmitted from. Additionally, the server 210 may be configured to associate a location with each lighting device 230 of the network of lighting devices 230. The location may correspond to a location of the transmitting lighting device 230 within a structure or area containing the network of lighting devices 230. Accordingly, when the server 210 receives an indication of motion and/or occupancy, it may interpret the identifier included with the transmission to identify the location in which motion and/or occupancy was detected.

Additionally, in some embodiments, each lighting device 230 may include a global positioning system (GPS) device configured to provide a location of the lighting device 230. The location may be in any format, including, but not limited to, latitude/longitude. Accordingly, the lighting device 230 may transmit the location received from the GPS device to the server 210. Additionally, the server 210 may be configured to associate the location received from the transmitting lighting device 230 with a location within the area being monitored.

The server 210 may include a memory 260. The memory 260 may have stored thereon one or more patterns 270. A pattern 270 may be defined as an anticipated series or sequence of detections. Moreover, a pattern 270 may be defined as an anticipated series or sequence of detections within a given time period. Additionally, a pattern 270 may be defined as an anticipated series or sequence of detections at a given time of day or within a range of time during a period of the day.

The server 210 may be configured to record onto the memory 260 detections received from the network of lighting devices 230. Additionally, the server 210 may be configured to determine new patterns 270 from detections recorded onto the memory 260. Furthermore, the server 210 may be configured to modify existing patterns 270 from detections recorded onto the memory 260. Further, in some embodiments, the server 210 may be configured to identify a potential pattern 270 from detections recorded on the memory 260 perform a search on a connected pattern database as described hereinabove. Accordingly, the pattern database may include a repository of patterns that may be common to various monitoring systems. Moreover, these patterns may be accessible by the server 210. Additionally, the pattern database may include the capability for the patterns to be searched by the server 210. The server 210 may further be configured to retrieve a pattern 270 from the pattern database that may conform to the identified potential pattern. The retrieved pattern 270 may then be stored on the memory 260. Furthermore, the retrieved pattern 270 may be modified so as to conform to and better represent and anticipate the pattern identified by the server 210.

Additionally, at least one of the server 210 and the lighting devices of the network of lighting devices 230 may be configured to differentiate objects detected within the field of view as being a target or a non-target. More specifically, one of the server 210 and the lighting devices of the network of lighting devices 230 may include logic to differentiate between targets (e.g., humans or vehicles) and non-targets (e.g., stationary inanimate objects, moving inanimate objects, animals). More information regarding target/non-target differentiation may be found in U.S. patent application Ser. No. 13/715,085 titled Sustainable Outdoor Lighting System for Use in Environmentally Photo-Sensitive Area filed Dec. 14, 2012, the content of which is incorporated herein by reference in its entirety, except to the extent disclosure therein is inconsistent with disclosure herein.

Figure 3:
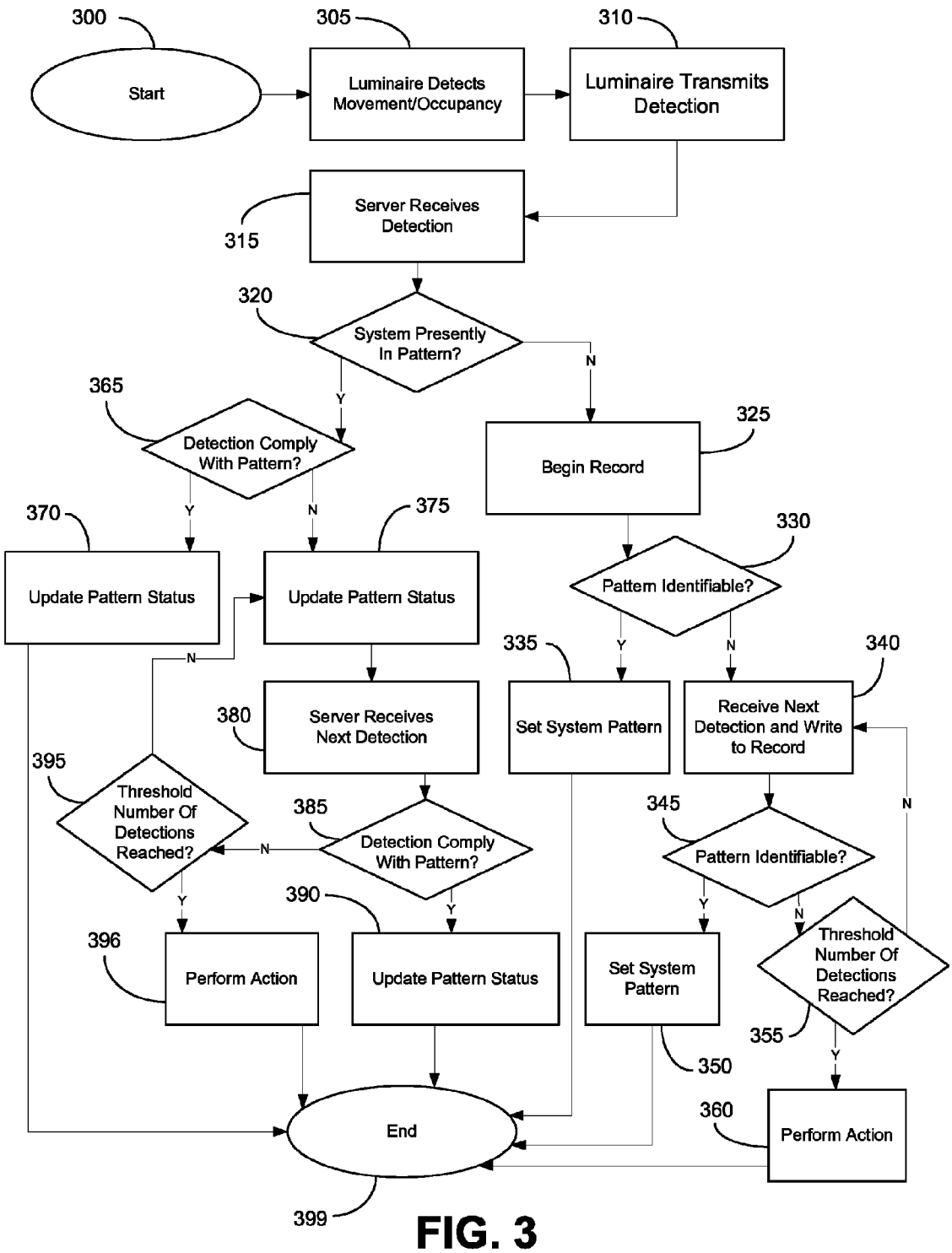
FIG. 3 is a flowchart illustrating the operation of a lighting system according to an embodiment of the invention.

Referring now to FIG. 3, a flowchart illustrating a method of operating a lighting system according to an embodiment of the invention is now discussed. Starting at Block 300, a luminaire of the plurality of luminaires may detect motion and/or occupancy at Block 305. At Block 310 the luminaire that detected motion and/or occupancy at Block 305 may transmit the detection across the network. The network may be any network described herein. At Block 315 the server may receive the detection and record the detection in a log of detections. The log of detections may be a sequential listing of the detection made by the plurality of luminaires of the system for a given time period, such as, for example, a 24-hour period. As described hereinabove, the log of detections may be written to and stored upon a memory associated with the server.

At Block 320, the server may determine if the system is presently in a pattern. This may be understood to mean that prior to the detection of movement/occupancy at Block 305, a previous movement/occupancy or series thereof had been detected, and a pattern identified therefrom, as will be described in greater detail hereinbelow.

If, at Block 320, it is determined that the system is not presently in a patter, then at Block 325 the server may begin a record. The record may be a series of detections recorded on memory in communication with the server as described hereinabove. At Block 330, the server may compare the record with a list of all known patterns and determine if a pattern is identifiable from the record. The patterns may be stored on the memory of the server, or may be stored in a pattern database that is accessible by the server as described hereinabove.

If at Block 330 it is determined that a pattern is identifiable from the record, then the server may set the system pattern at Block 335, meaning that the system is now presently in a patter as described hereinabove. The method may then end at Block 399. If, however, at Block 330 it is determined that a pattern is not identifiable from the record, the system may proceed to Block 330 where the serve may receive a subsequent detection as described in Blocks 305-315. At Block 345 the server may again attempt to determine if a pattern is identifiable from the record as updated at Block 330. If at Block 345 a pattern is identifiable, then the system pattern may be set at Block 350, and the method may end at Block 399.

If, however, at Block 345 it is determined that a pattern is not identifiable, the server may determine at Block 355 if a threshold number of detections has been reached. More specifically, the server may determine if a threshold number of detections have been added to the record. The threshold number may be any number of detections as determined by a user of the system. If the server determines the threshold number of detections has not been reached, the system may return to Block 340 and receive the next detection and record that detection. This may continue until either a pattern is identifiable at Block 345, or until the threshold number of detections is reached at Block 355. If it is determined that the threshold number of detections has been reached at Block 355, the system may perform an action at Block 360. Upon performance of the action, the method may end at Block 399.

The nature of the action performed may vary. In some embodiments, the action may include providing an alert. The alert may take many forms, including, but not limited to sending a message via text message, email, or telephone call to a designated person or device. Additionally, the alert may include them in an alert message to a monitoring service. In some embodiments, the alert may involve contacting emergency services. Additionally, the action may include providing a visual or auditory signal at a location either within the space being monitored by the system or, in some embodiments, a location remote from the monitored space. Accordingly, the server may be positioned in communication with a network that renders operable to various types of actions disclosed herein.

Returning to Block 320, if it is determined that the system is presently in a pattern, then at Block 365 the server may determine if the detection received at Block 315 complies with the pattern within which the system is presently in. The analysis of determining compliance of the detection with the pattern may be determined by factoring in of a number of elements, including preceding detections, the present status/position of the pattern, and anticipated detections. Anticipated detections may be an anticipated movement and/or occupancy of a target by a luminaire. It is contemplated and included within the scope of the invention that the pattern may be, in some embodiments, the detection of motion and/or occupancy of a target by a luminaire at a specific location. In other embodiments, the pattern may be simply a level of activity as determined by the detection of motion, and/or the detection of occupancy of a target by two or more luminaires that may be interpreted to indicate motion of the target. Accordingly, in some embodiments, a detection may be non-compliant with a pattern where no motion is detected, or where a target is detected to occupy a single location for a length of time that does not comply with the pattern the system is presently in.

If at Block 365 it is determined the detection received at Block 315 complies with the pattern, the server may update the pattern status at Block 370 to reflect the compliance. Updating the pattern status, similar to determining compliance, depends on a number of factors. In some embodiments, updating the pattern status may be advancing the pattern such that a determination of compliance of the next received detection may be determined based on criteria similar or identical to the criteria used in the determination made at Block 365, or the criteria may be different. In some embodiments, updating the pattern status may include indicating that the pattern has reached its termination point, in which case the system will no longer presently be in a pattern, and a new pattern will possibly be identified upon the next detection.

If at Block 365 it is determined that the detection received at Block 315 does not comply with the pattern, the server may update the pattern status at Block 375 to reflect the non-compliance. More specifically, the server may indicate that the previous detection deviated from the pattern. At Block 380, the server may receive the next detection as described in Blocks 305-315. At Block 385, the server may determine if the detection received at Block 380 complies with the pattern, as updated at Block 375. In some embodiments, the determination of compliance at Block 385 may be an analysis similar or identical to the analysis performed at Block 365, or the analysis may be different. Any difference between the analyses performed at Blocks 365 and 385 may be due, at least in part, to the update to the pattern performed at Block 375.

If it is determined at Block 385 that the detection received by the server at Block 380 complies with the pattern, the server may update the pattern status at Block 390, and the method may end at Block 399.

If it is determined at Block 385 that the detection received by the server at Block 380 does not comply with the pattern, the server may determine at Block 395 if a threshold number of detections has been reached. This determination may be similar to that performed at Block 355, with the distinction that instead of determining if the record includes the threshold number of detections, the server will analyze the pattern status. The pattern status may include an indication as to the number of non-compliant detections received, which may be added to the status when the pattern status is updated at Block 375. The threshold number of Block 395 may be any number of detections, and may be set by a user of the system. Additionally, the threshold number of Block 395 may be the same as the threshold number for Block 355, or it may be different.

If it is determined at Block 395 that the threshold number of detections has not been reached, the system may return to Block 375 wherein the pattern status may be updated to include the determination of non-compliance made at Block 385. The method may then continue to Block 380 with the receipt of the next detection by the server, and the determination of whether the next detection complies with the pattern at Block 385. This cycle may continue until it is determined either that at Block 385 the detection complies with the pattern, or it is determined at Block 395 that the threshold number of detections has been reached. If it is determined at Block 395 that the threshold number of detections has been reached, the server may perform an action at Block 396. The action performed at Block 396 may be any action as described hereinabove. Moreover, the action performed at Block 396 may be the same as the action performed at Block 360, or it may be different. Additionally, in some embodiments, that nature of the action performed at Blocks 360 and 396, respectively, may convey differing meanings. The differing meanings may reflect the difference in how the actions came to be performed, those differences being the inability of the system to identify a pattern, and the deviation of a target from a pattern. Once the action has been performed at Block 396, the method may end at Block 399.

Figure 4:
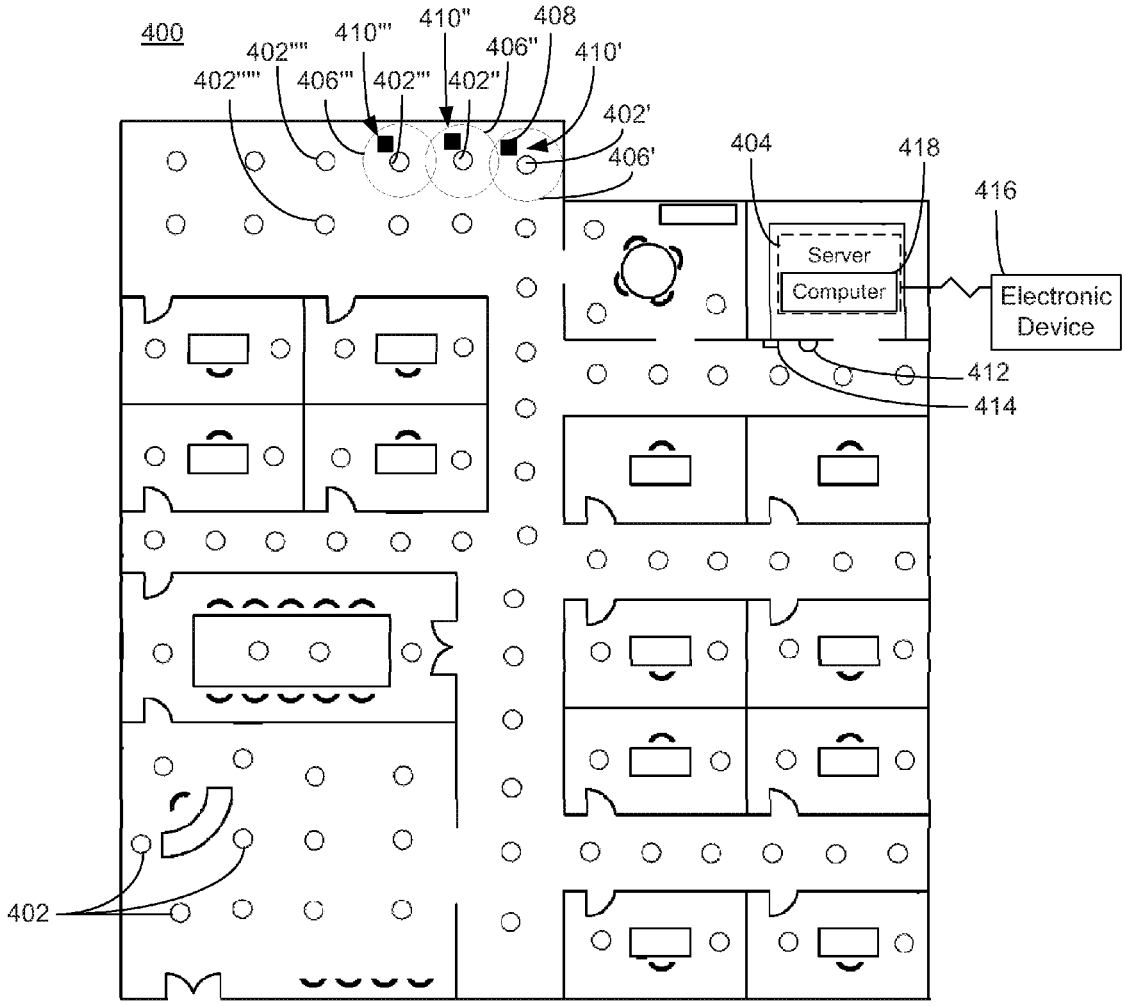
FIG. 4 is an environmental schematic view of a lighting system according to an embodiment of the present invention positioned within a structure.

Referring now to FIG. 4, an environmental schematic view of a lighting system according to an embodiment of the present invention positioned within a structure is presented. In the depicted embodiment, a network 400 comprising a plurality of lighting devices 402 is shown installed in an environment. While the present depiction is of an office-type environment, it is contemplated and included within the scope of the invention that the network 400 may be positioned in any environment, including residences, individual or community, commercial settings, retail settings, and industrial settings.

As discussed hereinabove, the network 400 may additionally include a server 404. In the present embodiment, the server 404 may integrally include a networking device configured to communicate with the plurality of lighting devices 402. The server 404 may have direct communication with each lighting device 402 of the plurality of lighting devices 402, or communication may be accomplished via a mesh networking configuration.

Each of the lighting devices 402 of the plurality of lighting devices 402 may be configured to detect motion and/or occupancy within a field of view of the lighting device 402. The field of view of the lighting device may be determined by consideration of a variety of factors, including, but not limited to, the means for accomplishing motion and/or occupancy detection, such as a video sensor, reverse-biased LEDs, acoustic detectors, and any other detection device disclosed herein, as well as environmental factors, including obstructions and other types of interference. In the present embodiment, fields of view 406 of some of the plurality of lighting devices 402 are depicted. The fields of view 406 are illustrative only and do not limit the fields of view, in terms of shape, size, or orientation.

As shown in FIG. 4, a first lighting device 402' may have associated therewith a first field of view 406', a second lighting device 402" may have associated therewith a second field of view 406", and a third lighting device 402'" may have associated therewith a third field of view 406'". In some embodiments, as in the present embodiment, the lighting devices 402', 402", 402'" may be positioned such that their associated fields of view 406', 406", 406'" may overlap with at least one other field of view associated with a lighting device. Such positioning may provide for continuous monitoring of motion and/or occupancy of a target by the network 400. It is contemplated and included within the scope of the invention that such overlapping coverage is not necessary and not integral with the invention. In some embodiments, where there is not overlapping fields of view 406', 406", 406'" of the plurality of lighting devices 402', 402", 402'", the server 404 may be configured to infer the position of a target within the network 400 based upon the last detection of motion and/or occupancy of the target by one lighting device 402 of the network and the gap between the detecting lighting device 402 and lighting devices 402 adjacent thereto.

As described hereinabove, the network 400 may be configured to detect a pattern of a target 408 within view of the network 400. More specifically, the server 404 may be configured to analyze a series of detections of motion and/or occupancy received from the plurality of lighting devices 402 and determine a pattern of motion therefrom. In the present embodiment, a first lighting device 402' may detection the motion and/or occupancy of the target 408 at a first position 410' within the field of view 406' associated with the first lighting device 402'. The first lighting device 402' may transmit an indication of the detection to the server 404. Subsequently, a second lighting device 402" may detect the motion and/or occupancy of the target 408 at a second position 410" within the field of view 406" associated with the second lighting device 402". The second lighting device 402" may transmit an indication of the detection to the server 404. Subsequently, a third lighting device 402'" may detect the motion and/or occupancy of the target 408 at a third position 410'" within the field of view 406'" associated with the third lighting device 402'". The third lighting device 402'" may transmit an indication of the detection to the server 404. Upon receiving each of the indications of transmission from the first, second, and third lighting devices 402', 402", 402'", the server 404 may attempt to determine a pattern of movement/occupancy of the target 408 according to the method described in FIG. 3.

In some embodiments, the server may identify a single pattern matching the sequence of detections received from the lighting devices 402', 402", 402'", and may predict the next detection to be received from a fourth lighting device 402"". In some embodiments, the server 404 may identify two or more potential patterns matching the sequence of detections received from the lighting devices 402', 402", 402'", and may predict the next detection from two or more lighting devices 402"", 402""".

Additionally, the server 404 may be unable to determine a pattern matching the sequence of detections received from the lighting devices 402', 402", 402'", and if a threshold number of non-identifiable detections has been reached, the server may perform an action as described hereinabove, including, but not limited to, broadcasting an alert at one or more of a warning light 412 and a speaker 414, and transmitting an alert to an electronic device 416.

As described hereinabove, a user of the network 400 may configured the network to perform an action. The configuration of the network 400 may be accomplished by any means known in the art, including, but limited to, configuration using a computerized device 418 in electrical communication with the server 404. In some embodiments, the computerized device 418 may be a terminal of the server 404. In some embodiments, the computerized device 418 may be a personal computer, smartphone, tablet computer, or other consumer product positioned in communication with the server 404 across a network, such as, for example, the Internet. Any means or method of communicating with the server 404 so as to set and/or execute the actions to be performed are contemplated and included within the scope of the invention.

Similarly, a user may be able to use the computerized device 418 to set or adjust the threshold levels described in FIG. 3 above.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of monitoring movement and predicting a pattern of an individual by a monitoring system comprising a server and a plurality of occupancy-detecting luminaires in communication with the server, the method comprising the steps of:

detecting a potential indication of occupancy at a luminaire of the plurality of luminaires;

determining whether the indication of occupancy is a target or non-target;

transmitting from the luminaire an indication of a detected occupancy of an individual;

receiving the indication of a detected occupancy of an individual from the luminaire at the server;

determining if the system is presently in a pattern for the individual associated with the indication of detected occupancy by the server;

upon a determination that the system is not presently in a pattern, performing the steps of:

writing the indication of detected occupancy to a record, comparing the record to a database of patterns, and determining if a pattern is identifiable from the record; and upon a determination that the system is presently in a pattern, determining whether the indication of detected occupancy complies with the pattern.

2. The method of claim 1 further comprising the step of, upon a determination that a pattern is identifiable, setting a system pattern.

3. The method of claim 1 further comprising the steps of, upon a determination that a pattern is not identifiable:

receiving a subsequent indication of detected occupancy;

writing the subsequent indication of detected occupancy to the record; and determining if a pattern is identifiable from the record.

4. The method of claim 3 further comprising the steps of:

determining if a threshold number of indications of detected occupancies has been reached;

upon determining that a threshold number of indications of detected occupancies has been reached, performing an action responsive to reaching the threshold number of indications of detected occupancies; and upon determining that a threshold number of indications of detected occupancies has not been reached, iteratively performing the steps of:

receiving a subsequent indication of detected occupancy, writing the subsequent indication of detected occupancy to the record, determining if a pattern is identifiable from the record, and determining if a threshold number of detections has been reached;

until at least one of determining a pattern is identifiable and determining the threshold number of indications of detected occupancies has been reached.

5. The method of claim 4 wherein the step of performing an action responsive to reaching the threshold number of detections comprises at least one of providing an alert in the form of a text message, email, or telephone call, providing an alert to a monitoring services, contacting emergency services, providing a visual signal, and providing an audio signal.

6. The method of claim 1 further comprising the step of, upon a determination that the indication of detected occupancy is compliant with the pattern, performing the step of updating a status of the pattern of the system responsive to compliance of the indication of detected occupancy.

7. The method of claim 1 further comprising the steps of, upon a determination that an indication of detected occupancy is non-compliant with the pattern:

updating a status of the pattern of the system responsive to the occupancy being non-compliant with the pattern;

receiving a subsequent indication of detected occupancy; and determining if the subsequent indication of detected occupancy is compliant with the pattern.

8. The method of claim 7 further comprising the steps of:

determining if a threshold number of indications of detected occupancies that are non-compliant has been reached;

upon determining that a threshold number of indications of detected occupancies that are non-compliant has been reached, performing an action responsive to reaching the threshold number of indications of detected occupancies that are non-compliant; and upon determining that a threshold number of indications of detected occupancies that are non-compliant has not been reached, iteratively performing the steps of:

updating the status of the pattern of the system responsive to the non-compliance;

receiving a subsequent indication of detected occupancy, determining if the subsequent indication of detected occupancy is compliant with the pattern, and determining if a threshold number of indications of detected occupancies that are non-compliant has been reached;

until at least one of determining a subsequent indication of detected occupancy is compliant with the pattern and determining the threshold number of indications of detected occupancies that are non-compliant has been reached.

9. The method of claim 8 wherein the step of performing an action responsive to reaching the threshold number of detections comprises at least one of providing an alert in the form of a text message, email, or telephone call, providing an alert to a monitoring services, contacting emergency services, providing a visual signal, and providing an audio signal.

10. The method according to claim 1 wherein the identification of a pattern is responsive to the plurality of occupancy-detecting luminaires being positioned in one of a residential environment, a commercial environment, or a retail environment.

11. The method according to claim 1 further comprising the step of determining the time of day at which the indication of detected occupancy occurred.

12. The method according to claim 11 wherein the steps of determining if a pattern is identifiable from the record and determining whether the indication of detected occupancy complies with the pattern are performed responsive to the time of day at which the indication of detected occupancy occurred.

13. A method of monitoring movement and predicting a pattern of an individual by a monitoring system comprising a server and a plurality of occupancy-detecting luminaires in communication with the server, the method comprising the steps of:

detecting a potential indication of occupancy at a luminaire of the plurality of luminaires;

determining whether the indication of occupancy is a target or non-target;

transmitting from the luminaire an indication of a detected occupancy of an individual:

receiving the indication of a detected occupancy of an individual from the luminaire at the server;

determining if the system is presently in a pattern for the individual associated with the indication of detected occupancy;

upon a determination that the system is not presently in a pattern, performing the steps of:

writing the indication of detected occupancy to a record, comparing the record to a database of patterns, determining if a pattern is identifiable from the record, upon a determination that a pattern is identifiable, performing the step of setting a system pattern, and upon a determination that a pattern is not identifiable, performing the steps of:

receiving a subsequent indication of detected occupancy, writing the subsequent indication of detected occupancy to the record, and determining if a pattern is identifiable from the record;

upon a determination that the system is presently in a pattern, performing the steps of:

determining whether the indication of detected occupancy complies with the pattern, upon a determination that the indication of detected occupancy is compliant with the pattern, updating the status of the pattern of the system responsive to compliance of the indication of detected occupancy, and upon a determination that indication of detected occupancy is non-compliant with the pattern, performing the steps of:

updating the status of the pattern of the system responsive to the non-compliance, receiving a subsequent indication of detected occupancy, and determining if the subsequent indication of detected occupancy is compliant with the pattern.

14. The method of claim 13 further comprising the steps of:

determining if a threshold number of detections has been reached;

upon determining that a threshold number of detections has been reached, performing an action responsive to reaching the threshold number of detections; and upon determining that a threshold number of detections has not been reached, iteratively performing the steps of:

receiving a subsequent indication of detected occupancy, writing the subsequent indication of detected occupancy to the record, determining if a pattern is identifiable from the record, and determining if a threshold number of detections has been reached;

until at least one of determining a pattern is identifiable and determining the threshold number of detections has been reached.

15. The method of claim 13 further comprising the steps of:

determining if a threshold number of indications of detected occupancies that are non-compliant has been reached;

upon determining that a threshold number of indications of detected occupancies that are non-compliant has been reached, performing an action responsive to reaching the threshold number of indications of detected occupancies that are non-compliant; and upon determining that a threshold number of indications of detected occupancies that are non-compliant has not been reached, iteratively performing the steps of:

updating that status of the pattern of the system responsive to the non-compliance, receiving a subsequent indication of detected occupancy, determining if the subsequent indication of detected occupancy is compliant with the pattern, and determining if a threshold number of indications of detected occupancies that are non-compliant has been reached;

until at least one of determining a subsequent indication of detected occupancy is compliant with the pattern and determining the threshold number of indications of detected occupancies that are non-compliant has been reached.

16. The method of claim 13 wherein the step of performing an action responsive to reaching the threshold number of detections comprises at least one of providing an alert in the form of a text message, email, or telephone call, providing an alert to a monitoring services, contacting emergency services, providing a visual signal, and providing an audio signal.

17. The method of claim 13 wherein the step of performing an action responsive to reaching the threshold number of detections comprises at least one of providing an alert in the form of a text message, email, or telephone call, providing an alert to a monitoring services, contacting emergency services, providing a visual signal, and providing an audio signal.

18. The method according to claim 17 wherein the identification of a pattern is responsive to the plurality of occupancy-detecting luminaires being positioned in one of a residential environment, a commercial environment, or a retail environment.

19. The method according to claim 13 further comprising the step of determining the time of day at which the indication of detected occupancy occurred.

20. The method according to claim 19 wherein the steps of determining if a pattern is identifiable from the record and determining whether the indication of detected occupancy complies with the pattern are performed responsive to the time of day at which the indication of detected occupancy occurred.

* * * * *